US006648756B2

(12) United States Patent
Moody

(10) Patent No.: US 6,648,756 B2
(45) Date of Patent: Nov. 18, 2003

(54) HIGH/LOW NUMBER GAME

(76) Inventor: Ernest W. Moody, 2116 Redbird Dr., Las Vegas, NV (US) 89134

( * ) Notice: Subject to any disclaimer, the term of this patent is extended or adjusted under 35 U.S.C. 154(b) by 0 days.

(21) Appl. No.: 10/266,537

(22) Filed: Oct. 7, 2002

(65) Prior Publication Data

US 2003/0036421 A1 Feb. 20, 2003

Related U.S. Application Data

(63) Continuation-in-part of application No. 09/758,413, filed on Jan. 10, 2001, now Pat. No. 6,475,085, which is a continuation-in-part of application No. 09/441,412, filed on Nov. 16, 1999, now Pat. No. 6,478,677.

(51) Int. Cl.[7] ..... A63F 5/00

(52) U.S. Cl. ..... 463/18; 463/16; 463/17; 463/19; 273/19; 273/269; 273/237; 273/139

(58) Field of Search ..... 463/16, 17, 18, 463/19; 273/269, 237, 139, 39

(56) References Cited

U.S. PATENT DOCUMENTS

| | | | | |
|---|---|---|---|---|
| 3,819,186 A | * | 6/1974 | Hinterstocker | 463/17 |
| 4,004,812 A | * | 1/1977 | Lutz | 273/292 |
| 5,106,089 A | | 4/1992 | Wood | 273/139 |
| 5,651,735 A | | 7/1997 | Baba | 463/18 |
| 5,909,875 A | | 6/1999 | Weingardt | 273/269 |
| 5,935,001 A | | 8/1999 | Baba | 463/18 |
| 6,102,403 A | * | 8/2000 | Kaufman | 273/292 |
| 6,371,485 B1 | * | 4/2002 | Daines | 273/303 |

OTHER PUBLICATIONS

Scarne's New Complete Guide to Gambling, John Scarne, pp. 490–499, copyright 1974.

* cited by examiner

*Primary Examiner*—Jessica Harrison
*Assistant Examiner*—Yveste Cherubin
(74) *Attorney, Agent, or Firm*—John Edward Roethel

(57) ABSTRACT

In connection with a game of chance in which numbers are selected, a player may wager that the lowest of the selected numbers may be a "high" number or the highest of the selected numbers may be a "low" number. If the player has correctly wagered on the "high" number or the "low" number, the player receives a payout with the amount of payout varying depending on how low the "high" number is or on how high the "low" number is.

16 Claims, 2 Drawing Sheets

HIGH/LOW NUMBER GAME

CROSS-REFERENCE TO RELATED APPLICATION

This application is a Continuation-in-Part of application Ser. No. 09/441,412, entitled "Numerical Total Keno Game", filed Nov. 16, 1999, now U.S. Pat. No. 6,478,677 and is a Continuation-in-Part of application Ser. No. 09/758,413, entitled "Numerical Total High/Low Lottery Game", filed Jan. 10, 2001, now U.S. Pat. No. 6,475,085. The disclosure of each of these earlier applications is incorporated herein by this reference, with the earlier applications being commonly owned with this application.

This invention relates primarily to a live or electronic video number game, and more particularly to a live or electronic video number game, such as Keno games, Roulette games, Dice games or Lottery games in which the player wagers on whether the lowest number drawn will be a high number or whether the highest number drawn will be a low number.

BACKGROUND OF THE INVENTION

Many states offer lottery games. While these state lottery games have taken many forms, the traditional lottery game involves a player selecting six numbers from a pool of fifty total numbers. After the player makes his selection, the operator of the lottery selects six numbers from the total pool of numbers. The player wins or loses based on the quantity of matches between the numbers selected by the player and the numbers selected by the operator. The player can win very large payouts for correctly picking all six winning lottery numbers.

Other lottery schemes involve picking more or less than six numbers and the size of the total pool of numbers can be more or less than fifty numbers. The drawing of the winning numbers can be done on a periodic basis, such as once a day or once a week. Alternatively, some lottery states offer instant lottery games in which the player picks three or four numbers and, using a computer with a random number generator, a quick pick of winning numbers is done concurrently with the player's number selection and the player knows immediately if he has won or lost.

The drawback to the conventional lottery game is that the player can only win if he matches the numbers selected by the lottery operator. The mathematical probability of the player winning is quite low and most plays are losing plays (which apparently is the appeal of lotteries to state governments which typically set the payouts so that 50% or more of the money wagered by the players is kept for the state treasury).

U.S. Pat. No. 5,106,089 (Wood) (the disclosure of which is incorporated herein) describes a lottery summing game in which the numerical total of the numbers drawn in a lottery game is summed and the player wagers on what the numerical total will be. The player is provided with a wagering slip upon which the player marks which numerical totals the player thinks the selected lottery numbers will total. The wagering slip shows various winning number groups from which the player may select one, some or all of the wagering number groups with each wagering number group requiring a separate wager. Each wagering number group has its associated payout odds.

As disclosed in this patent, the pool of lottery numbers range from 0 to 9 and there are three groups of lottery numbers, with one number being drawn from each group.

The three lottery numbers are drawn and the numerical value of the drawn lottery numbers is totaled. This final sum total is then compared to the player slips and any player who has selected the correct final sum total is a winner. A winning player is awarded odds based on the amount of his wager depending on what the final sum total is. The odds range from 250-for-1 down to 1.75-for-1. Other betting possibilities are disclosed, such as wagering that all three numbers are odd; all three numbers are even; two numbers are odd and one number is even; or two numbers are even and one number is odd.

The drawback of this method of play in the Wood '089 patent is that the player is limited to a very narrow range of possible winning combinations and the pool of numbers from which the winning numbers are drawn is quite small.

Conventional keno games are similar to lottery games. In keno games, the number pool usually has eighty numbers and twenty numbers are drawn. The player preselects from one to twenty numbers and the player wins based on the number of matches achieved by the player.

The drawback to the conventional keno games is that the player can only win if he matches a minimum number of his preselected numbers. The mathematical probability of the player winning is quite low and most plays are losing plays.

Likewise, conventional roulette games use a number grid having betting areas for the numbers 1 through 36 and either a single zero or both a single zero and a double zero. After the wagers are made, the roulette wheel is spun and a single number is selected. Again, the chances of winning are quite small as the player must have wagered on one of the betting areas that corresponds to the number selected by the roulette game operator.

The method of the present invention can be applied to any of the many number wagering games that involve selecting multiple numbers either in a single round of play or over the course of two or more rounds of play.

It is an object of the present invention to provide an improved wagering game that offers the player the opportunity to win large payouts depending on what the lowest or highest number may be when all of the numbers have been drawn.

It is a feature of the present invention to provide that a player may select that the lowest of the selected numbers may be a high number or the highest of the selected numbers may be a low number. If the player has correctly selected high or low, the player receives a payout with the amount of payout varying depending on how low the highest number is or on how high the lowest number is. This feature can be incorporated into any conventional game that selects more than one number either in a single round of play or over two or more rounds of play and the player can be awarded this additional payout in conjunction with any normal payouts that the player may win during the conventional number game. The player may engage in this high/low feature of a number game without having to make an additional wager, aside from the wager the player makes to participate in the conventional number game. Alternatively, the player can be required to make a second wager to be eligible for this high/low feature in addition to the conventional first wager to participate in the number game. Still as another alternative, the player may simply wager on the high/low game and not play in the regular number game.

It is an advantage of the present invention that a number game will be enhanced by this new and exciting feature and that the player can win a payout based on whether the lowest of the selected numbers is high or on whether the highest of the selected numbers if low. This will increase participation in the number games offered by the casino operator.

Other objects, features and advantages of the present invention will become apparent from a consideration of the following detailed description.

SUMMARY OF THE INVENTION

In connection with a game of chance in which numbers are selected, a player may choose that the lowest of the selected numbers may be a high number or the highest of the selected numbers may be a low number. If the player has correctly chosen "high" or "low", the player receives a payout with the amount of payout varying depending on how low the highest number is or on how high the lowest number is.

This feature can be incorporated into any conventional number game that selects more than one number either in a single round of play (such as a Keno game or a Lottery game) or over two or more rounds of play (such as a Roulette game or a dice game such as Craps). The player can be awarded this additional payout in conjunction with any normal payouts that the player may win during the conventional number game. The player may engage in this high/low feature of a number game without having to make an additional wager, aside from the wager the player makes to participate in the conventional number game. Alternatively, the player can be required to make a second wager to be eligible for this high/low feature in addition to the conventional first wager to participate in the number game. Still as another alternative, the player may simply wager on the high/low game and not play in the regular number game.

DETAILED DESCRIPTION OF THE PREFERRED EMBODIMENTS

The method of the present invention is played using either a live number game format or using an electronic number gaming machine. The description that follows refers to a live number game format, but the same principles of the present invention can be easily adapted to an electronic number gaming machine. The description that follows also refers to a conventional Keno game, but the same method of play can easily be applied to a conventional lottery game.

Figure 1:
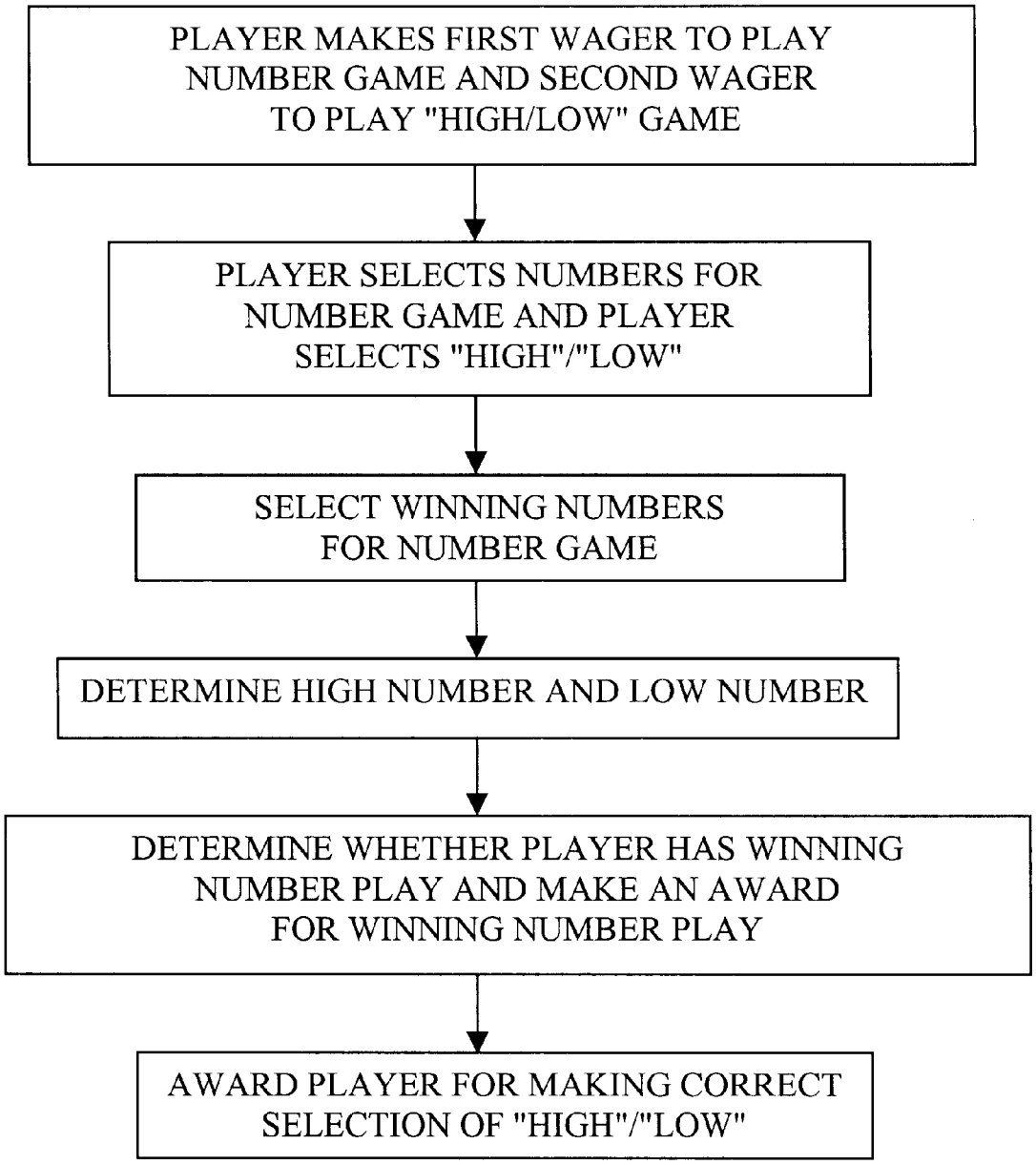
FIG. 1 shows a flow chart of the steps of the present invention played in conjunction with a conventional number game.
Figure 2:
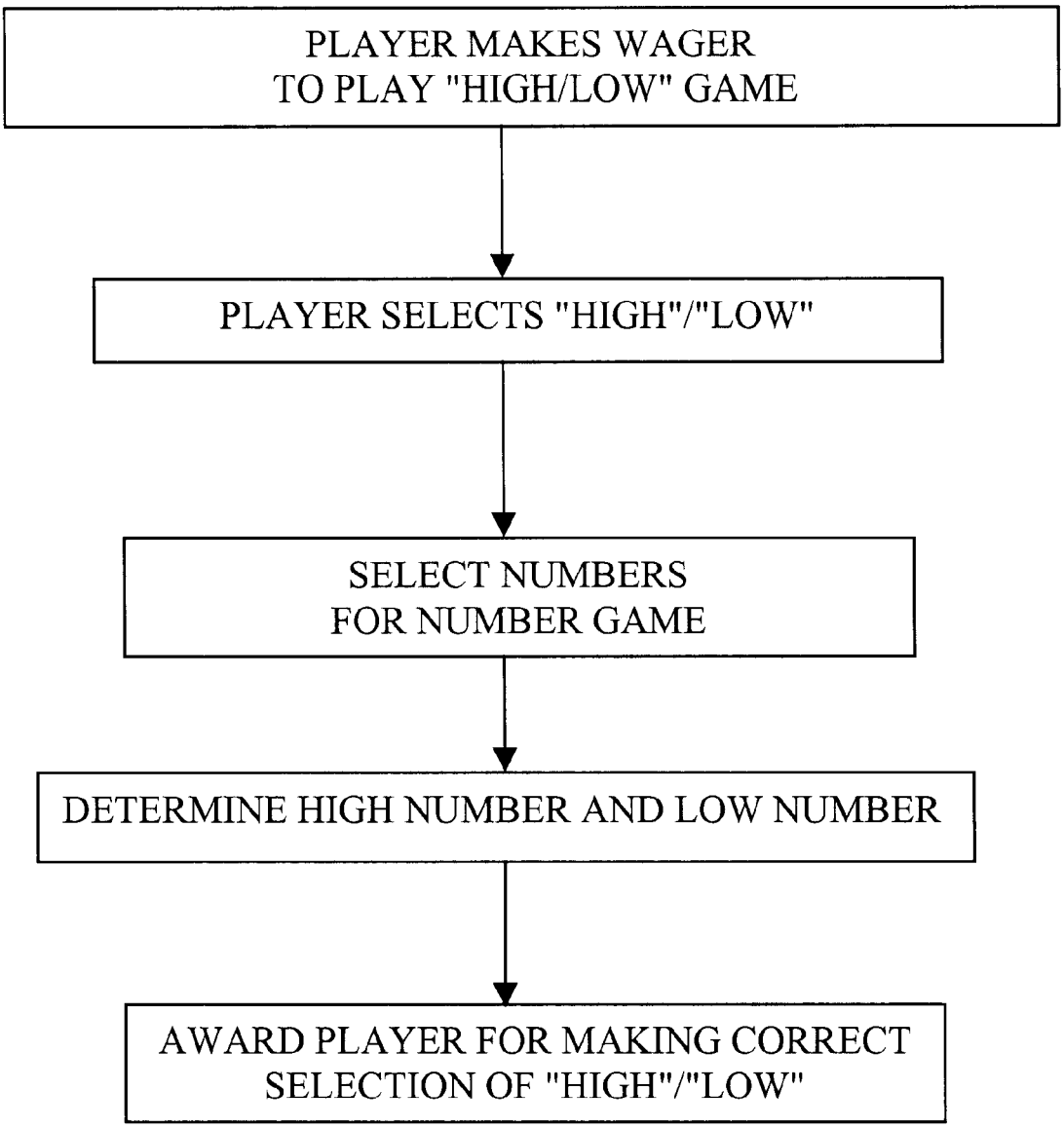
FIG. 2 shows a flow chart of the steps of the present invention played as a stand alone number game.

In accordance with the method of the present invention, a player participates in a conventional Keno game with the steps of the present invention being shown in the flow chart of FIG. 1. The player makes a first wager to participate in the Keno game and selects the desired amount of numbers, typically between one and fifteen, from the overall total number pool, typically eighty numbers designated as the numbers one through eighty. The player's numbers are marked on his keno ticket.

The player also makes a second wager and selects "High" or "Low". If the player selects "High", whether the player has a winning selection is determined by the lowest of the selected numbers. If the player selects "Low", whether the player has a winning outcome is determined by the highest of the selected numbers.

When the time for making wagers on the Keno game has expired, the Keno game is closed and the operator of the Keno game begins selecting the winning Keno numbers for that particular round of the Keno game. As is conventional, twenty winning Keno numbers are selected from the total number pool of eighty numbers.

The player compares the player's selected numbers to the winning Keno numbers and the player determines if he has a winning occurrence in the conventional Keno game. The player receives an award, typically a monetary payout (but which could take the form of other consideration such as a car, a boat, a vacation trip or some other valuable item or prize), based on the number of matches the player has achieved between the player's numbers and the selected winning Keno numbers. Typically, the player wins a small value award for matching some numbers and a large value award for matching all of the numbers. If the player has no matches or less than the minimum number of matches required to have a winning player, then the player has a losing play.

The lowest and highest of the selected numbers are also established at the time the winning keno numbers are selected.

The highest Keno number drawn becomes the "Low" number for the purposes of determining the amount of any winning payouts for players who selected "Low". The lowest Keno number drawn becomes the "High" number for the purposes of determining the amount of any winning payouts for player who selected "High".

For example, assume that the following Keno numbers are selected as the twenty winning Keno numbers: 21, 23, 27, 28, 29, 33, 37, 46, 47, 49, 50, 55, 57, 60, 62, 63, 64, 70, 75 and 78. The "Low" number would be 78 and the "High" number would be 21.

A suitable pay table is provided which shows the amount of the winning payouts for successful wagers on the "High" or "Low". For example, Table 1 shows a representative pay table for players selecting "Low".

TABLE 1

| RANGE | ODDS PAYOUT |
|---|---|
| 20–46 | 5000 FOR 1 |
| 47–51 | 500 FOR 1 |
| 52–56 | 100 FOR 1 |
| 57–61 | 20 FOR 1 |
| 62–77 | 2 FOR 1 |
| 78–80 | LOSE |

Table 2 shows a representative pay table for players selecting "High".

TABLE 2

| RANGE | ODDS PAYOUT |
|---|---|
| 35–61 | 5000 FOR 1 |
| 30–34 | 500 FOR 1 |
| 25–29 | 100 FOR 1 |
| 20–24 | 20 FOR 1 |
| 4–19 | 2 FOR 1 |
| 1–3 | LOSE |

With reference to the above example, because the winning "Low" number is 78, each player who had wagered on "Low" would have a losing play and would lose the amount of his second wager.

Also with reference to the above example, because the winning "High" number is 21, each player who had wagered on "High" would win a payout of twenty-for-one odds on the amount of his second wager.

Winning and losing plays for the conventional Keno wager made by the player is also determined based on comparing the player's selected numbers to the winning Keno numbers that have been selected. Any suitable conventional Keno pay table may be used.

Any suitable pay tables can be used for both the conventional Keno game and the "High"/"Low" game and the foregoing example should be considered as illustrative, rather than limiting.

The method of the present invention has been described in the context of the conventional keno format which uses a total number pool of eighty numbers, from which twenty numbers are drawn each game. However, the present invention can also be applied to a keno-type game in which the size of the complete pool can be more or less than eighty numbers and in which the amount of numbers drawn can be more or less than twenty numbers. If the size of the complete pool is changed and/or the amount of numbers drawn is changed, then the payouts can also be changed to reflect the varying mathematical odds which are based on the size of the complete pool and the amount of numbers drawn.

The method of the present invention may also be played in conjunction with a conventional Keno game without requiring the player to make a second wager to participate in the "High/Low" game. The player would make a single wager which would cover his participation in both the conventional Keno game and the "High/Low" game. In this situation, the pay tables for the Keno game and the "High/Low" game would be adjusted so that the overall game return of the combined games would be acceptable to the gaming operator.

The method of the present invention may also be played as a stand alone game separate from player participation in a regular conventional keno game. The player would make a suitable wager on "High" or "Low" and the outcome of this wager would be determined based on the numbers drawn during the play of the number game.

The player may also separate wagers for either the "High" outcome, the "Low" outcome or both the "High" and "Low" outcome.

The method of the present invention may also be applied to a conventional lottery game in which fifty number form the pool and six numbers are selected. The player makes a first wager to participate in the conventional lottery game and the player selects his lottery numbers. The player also makes a second wager and the player chooses "High" or "Low". The six lottery numbers are selected in any conventional manner such as from a ball blower or by a computer.

The highest lottery number drawn becomes the "Low" number for the purposes of determining the amount of any winning payouts for players who selected "Low". The lowest lottery number drawn becomes the "High" number for the purposes of determining the amount of any winning payouts for player who selected "High". Any suitable pay table may be provided for this "High/Low" game.

This "High/Low" game would be operated in conjunction with a typical lottery game. At the appointed time, say 7:00 PM at night, the winning lottery numbers for that day are selected by the operator of the lottery. Alternatively, the winning lottery numbers can be selected once a week, once a month or once each hour or on whatever periodic basis is desired by the lottery operator. The player compares the player's selected numbers to the winning lottery numbers and the player determines if he has a winning occurrence in the conventional lottery game. The player receives an award, typically a monetary payout (but which could take the form of other consideration such as a car, a boat, a vacation trip or some other valuable item or prize), based on the number of matches the player has achieved between the player's numbers and the selected winning lottery numbers. Typically, the player wins a small award for matching three numbers and a very large payout for matching all of the numbers, usually six numbers. If the player matches two or fewer numbers, the player normally has a losing play.

The "High" number result is determined and the "Low" number result is determined. Winning payouts are made depending on how low the "High" number result is and how high the "Low" number result is.

The method of the present invention has been described in the context of the conventional lottery format which uses a total number pool of fifty numbers, from which six numbers are drawn each game. However, the present invention can also be applied to a lottery-type game in which the size of the complete pool can be more or less than fifty numbers and in which the amount of numbers drawn can be more or less than six numbers. If the size of the complete pool is changed and/or the amount of numbers drawn is changed, then the payouts can also be changed to reflect the varying mathematical odds which are based on the size of the complete pool and the amount of numbers drawn.

The method of the present invention may also be played in conjunction with a conventional lottery game without requiring the player to make a second wager to participate in the "High/Low" game. The player would make a single wager which would cover his participation in both the conventional lottery game and the "High/Low" game. In this situation, the pay tables for the lottery game and the "High/Low" game would be adjusted so that the overall game return of the combined games would be acceptable to the gaming operator.

The method of the present invention may also be played as a stand alone game separate from player participation in a regular conventional lottery game. The player would make a suitable wager on "High" or "Low" and the outcome of this wager would be determined based on the numbers drawn during the play of the lottery game.

The player may also separate wagers for either the "High" outcome, the "Low" outcome or both the "High" and "Low" outcome.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a number game, comprising:

a) a player selecting a predetermined amount of numbers as the player's numbers for the number game;

b) the player also selecting for a "high/low" feature of the number game either a "high" number result, a "low" number result or both the "high" number result and the "low" number result;

c) randomly selecting a predetermined amount of winning numbers from a pool of numbers;

d) determining the amount of matches between the player's numbers and the winning numbers and providing the player with a first award if the player achieves at least a minimum amount of matches;

e) designating the highest number drawn as the "low" number result and designating the lowest number drawn as the "high" number result; and f) providing the player with a second award depending on how high the "low" number result is or on how low the "high" number result is.

2. The method of claim 1 in which a player makes a first wager to participate in the number game and the player makes a second wager to play the "high/low" feature; and the first award to the player is based on the player's first wager and the second award to the player is based on the player's second wager.

3. The method of claim 1 in which the predetermined amount of player numbers selected is from one to twenty, the amount of numbers in the pool of numbers is eighty and the amount of winning numbers selected is twenty.

4. The method of claim 1 in which the predetermined amount of player numbers selected is six, the amount of numbers in the pool of numbers is fifty and the amount of winning numbers selected is six.

5. A method of playing a number game, comprising:

a) a player selecting a predetermined amount of numbers as the player's numbers for the number game;

b) the player also selecting for a "high/low" feature of the number game either a "high" number result or a "low" number result;

c) randomly selecting a predetermined amount of winning numbers from a pool of numbers;

d) determining the amount of matches between the player's numbers and the winning numbers and providing the player with a first award if the player achieves at least a minimum amount of matches;

e) designating the highest number drawn as the "low" number result and designating the lowest number drawn as the "high" number result; and f) providing the player with a second award depending on how high the "low" number result is or on how low the "high" number result is.

6. The method of claim 5 in which a player makes a first wager to participate in the number game and the player makes a second wager to play the "high/low" feature; and the first award to the player is based on the player's first wager and the second award to the player is based on the player's second wager.

7. The method of claim 5 in which the predetermined amount of player numbers selected is from one to twenty, the amount of numbers in the pool of numbers is eighty and the amount of winning numbers selected is twenty.

8. The method of claim 5 in which the predetermined amount of player numbers selected is six, the amount of numbers in the pool of numbers is fifty and the amount of winning numbers selected is six.

9. A method of playing a number game, comprising:

a) a player selecting either a "high" number result, a "low" number result or both the "high" number result and the "low" number result;

b) randomly selecting a predetermined amount of winning numbers from a pool of numbers;

c) designating the highest number drawn as the "low" number result and designating the lowest number drawn as the "high" number result; and d) providing the player with an award depending on how high the "low" number result is or on how low the "high" number result is.

10. The method of claim 9 in which a player makes a wager to play the "high/low" feature; and the award to the player is based on the player's wager.

11. The method of claim 9 in which the predetermined amount of player numbers selected is from one to twenty, the amount of numbers in the pool of numbers is eighty and the amount of winning numbers selected is twenty.

12. The method of claim 9 in which the predetermined amount of player numbers selected is six, the amount of numbers in the pool of numbers is fifty and the amount of winning numbers selected is six.

13. A method of playing a number game, comprising:

a) a player selecting either a "high" number result or a "low" number result;

b) randomly selecting a predetermined amount of winning numbers from a pool of numbers;

c) designating the highest number drawn as the "low" number result and designating the lowest number drawn as the "high" number result; and d) providing the player with an award depending on how high the "low" number result is or on how low the "high" number result is.

14. The method of claim 13 in which a player makes a wager to play the "high/low" feature; and the award to the player is based on the player's wager.

15. The method of claim 13 in which the predetermined amount of player numbers selected is from one to twenty, the amount of numbers in the pool of numbers is eighty and the amount of winning numbers selected is twenty.

16. The method of claim 13 in which the predetermined amount of player numbers selected is six, the amount of numbers in the pool of numbers is fifty and the amount of winning numbers selected is six.

* * * * *